US005693924A

United States Patent [19]

Fetterolf, Sr. et al.

[11] Patent Number: 5,693,924

[45] Date of Patent: Dec. 2, 1997

[54] SWITCHING CONTACT MECHANISM WITH WIPE AND BACKWIPE

[75] Inventors: James Ray Fetterolf, Sr., Mechanicsburg; David Keay Fowler, Boiling Springs; Randall Robert Henry, Harrisburg; David William Rupnik, Mechanicsburg, all of Pa.

[73] Assignee: The Whitaker Corporation, Wilmington, Del.

[21] Appl. No.: 615,905

[22] Filed: Mar. 14, 1996

Related U.S. Application Data

[63] Continuation-in-part of Ser. No. 495,143, Jun. 28, 1995, abandoned.

[51] Int. Cl.[6] ..... H01H 13/70

[52] U.S. Cl. ..... 200/51.1; 200/51 R; 200/51.07; 439/188

[58] Field of Search ..... 200/51 R, 51.01, 200/51.02, 51.04, 51.08, 51.13, 51.12, 537, 538, 539, 253; 439/188, 856, 857

[56] References Cited

U.S. PATENT DOCUMENTS

| | | | |
|---|---|---|---|
| 1,526,102 | 2/1925 | Taft | 439/188 |
| 3,166,649 | 1/1965 | Frantz et al. | 200/51.1 |
| 3,976,850 | 8/1976 | Faber et al. | 200/51.1 |
| 4,408,824 | 10/1983 | Weidler | 439/857 |
| 4,633,048 | 12/1986 | Komatsu | 200/51.1 |
| 4,804,339 | 2/1989 | Cohen | 439/588 |
| 5,030,122 | 7/1991 | Birch et al. | 439/188 |
| 5,073,123 | 12/1991 | Birch et al. | 439/188 |
| 5,108,300 | 4/1992 | Weber | 439/620 |
| 5,267,871 | 12/1993 | Flanagan | 439/188 |
| 5,320,546 | 6/1994 | Weber | 439/188 |

FOREIGN PATENT DOCUMENTS

| | | | |
|---|---|---|---|
| 95/16292 | 6/1995 | WIPO | H01R 17/12 |

*Primary Examiner*—David J. Walczak

[57] ABSTRACT

This invention relates to a make-before-break switch of the type for electrical connector, where the connector is intended to be mated with a complementary coaxial cable connector. The switching connector comprises a pair of spaced-apart, cantilevered switch contacts mounted within a dielectric housing, where such mating is between the pair of switch contacts. A unique feature hereof is that the shank portion of one of the switch contacts has a contact arm extending toward and in contact with the shank portion of the other switch contact in an unmated condition, and that the respective mating ends of the switch contacts are axially offset from one another. By this arrangement, upon mating by the complementary connector, contact is made sequentially with the mating ends and the contact arm is caused to wipe along the shank portion of the first switch contact to counter the effects of contaminants and oxides which may be present at the contact point.

13 Claims, 9 Drawing Sheets

SWITCHING CONTACT MECHANISM WITH WIPE AND BACKWIPE

This is a Continuation-in-Part of application Ser. No. 08/495,143 filed on Jun. 28, 1995 now abandoned.

BACKGROUND OF THE INVENTION

This invention relates to a switch contact, such as an R.F. switch, that provides a contact area remote from the mating surfaces, while offering wipe and backwipe to the contacts to counter the effects of oxides and contaminates which may be introduced to the switching contact area.

Wipe and backwipe have long been a major concern of contacts, particularly cantilevered spring arms which offer only a limited area of contact. Since such spring arms are typically formed of sheet metal, such as phosphor bronze, oxides can present a problem for effective electrical contact. Metal oxides are typically nonconductive and can therefore cause electrical continuity problems. Additionally, contaminants at the contact area may effect performance. Accordingly, means for providing wipe and backwipe were devised to provide a cleaner contact area. Wiping by the complementary mating member provides a primary means to improving performance. However, where there are plural contact points between the contact arms, contamination problems remained.

U.S. Pat. No. 5,320,546, assigned to the assignee hereof, directed to a coaxial connector, shows a connector which has plural contact points. Briefly, the contact comprises a first switch contact and a second fixed switch contact, wherein the first switch contact comprises a biasing element and a deflection portion. The biasing element provides a closed switch between the first switch contact and the second switch contact. The deflection portion is located separate from said biasing element and provides for contact with a pin of a complementary connector. While wiping is achieved at the mating end of the first switch contact, there is no wiping with the biasing element and the second fixed switch contact.

The present invention represents a significant improvement to this prior art by providing plural wiping areas. The manner by which this is accomplished will become apparent to those skilled in the art from these specifications, particularly when read in conjunction with the accompanying drawings.

SUMMARY OF THE INVENTION

This invention is directed to an electrical switch connector of the type for communication equipment and the like, where the connector is intended to be mated with a complementary coaxial cable connector, and the mating action effects wiping between the switch contacts. The connector includes a dielectric housing having mounted therein a pair of spaced-apart, cantilevered switch contacts. Each of the switch contacts comprises a fixed end, a shank portion and a mating end, where the mating end includes a reverse bent portion. The improved feature of this make-before-break connector is the provision of the shank portion of one of the switch contacts including a contact arm extending toward and in contact with the shank portion of the other switch contact in an unmated condition. Further, the respective mating ends are axially offset from one another, whereby, upon mating by the complementary connector, contact is made sequentially with the mating ends and the contact arm is caused to wipe along the shank portion of the other switch contact to counter the effects of contaminants and oxides formed at the point of contact.

BRIEF DESCRIPTION OF DRAWINGS

FIGS. 11 to 13 are enlarged sectional views taken across the line 4—4 of FIG. 6 illustrating sequentially the mating of the switch connector of this invention with a complementary connector, to illustrate contact wiping at two significant contact locations.

DETAILED DESCRIPTION OF PREFERRED EMBODIMENT

This invention is directed to a switch contact, such as an R.F. switch, as a component of an electrical connector, where wipe and backwipe are critical to maintain the integrity and electrical continuity of the electrical connector.

Figure 1:
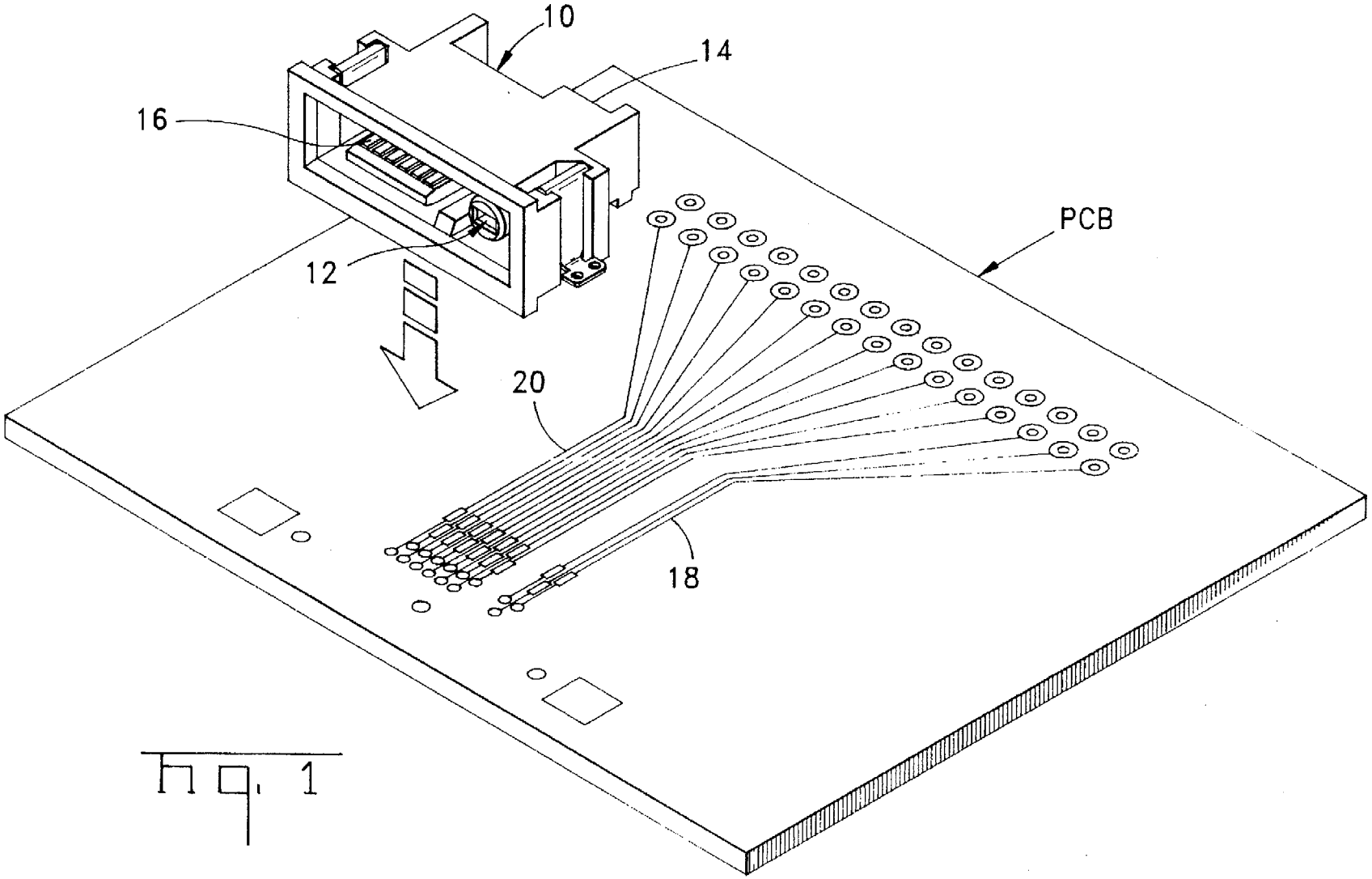
FIG. 1 is an exploded perspective view of an electrical connector utilizing the switch connector of this invention, and a planar electronic device, such as a printed circuit board, upon which the electrical connector is to be mounted.
Figure 2:
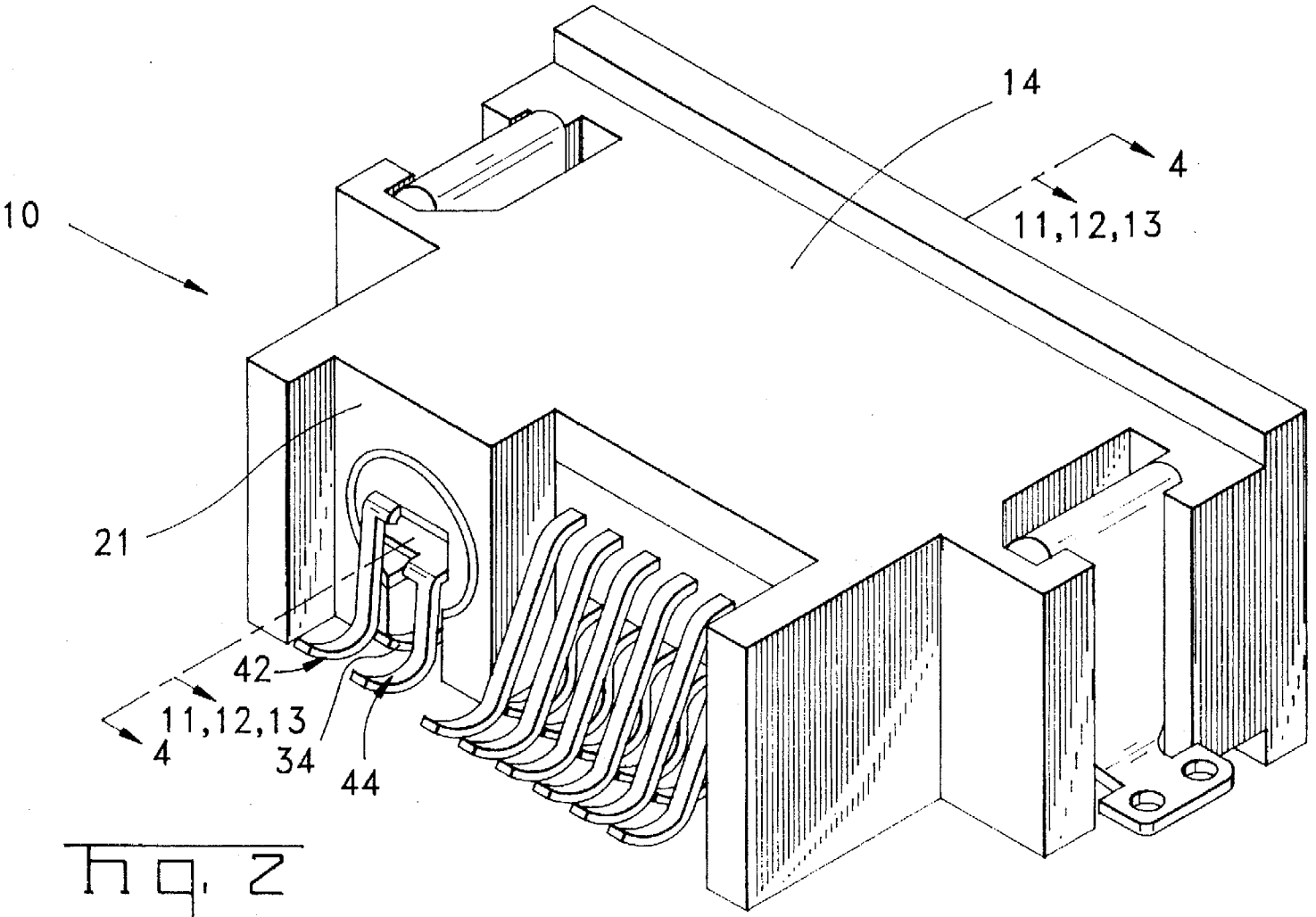
FIG. 2 is an enlarged perspective view taken from the rear of the electrical connector shown in FIG. 1.

The electrical switch connector 10 is illustrated in its preferred environment in FIG. 1. The switch contact 12 is typically mounted within a dielectric housing 14, and in this embodiment positioned adjacent plural signal contacts 16. When the housing 14 is surface mounted to a planar electronic device, such as a printed circuit board (PCB), the switch contact and signal contacts are electrically connected, such as by soldering, to appropriate circuit traces 18 and 20, respectively. FIG. 2 illustrates more clearly the solder tails projecting from the rear 21 of the housing 14.

Figure 4:
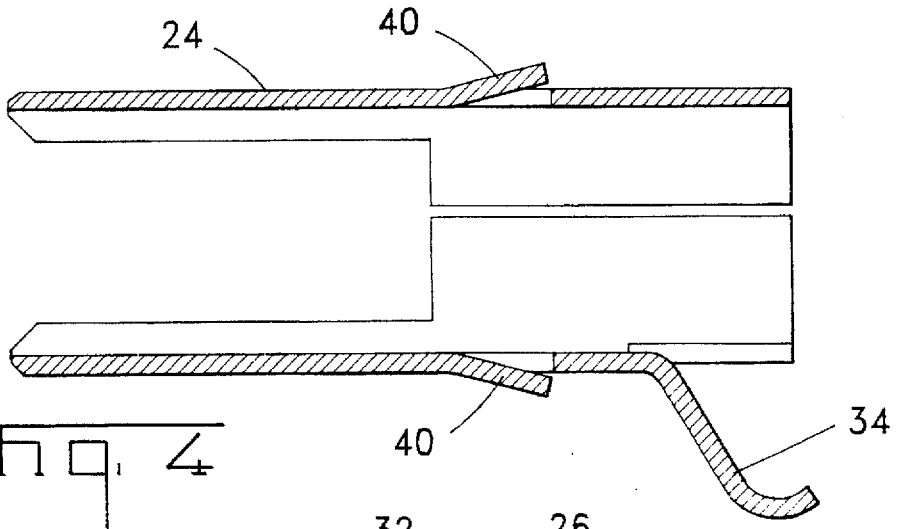
FIG. 4 is a sectional view taken across the line 4—4 of FIG. 2 of the metal shell member formed from the stamped sheet metal blank of FIG. 3.
Figure 3:
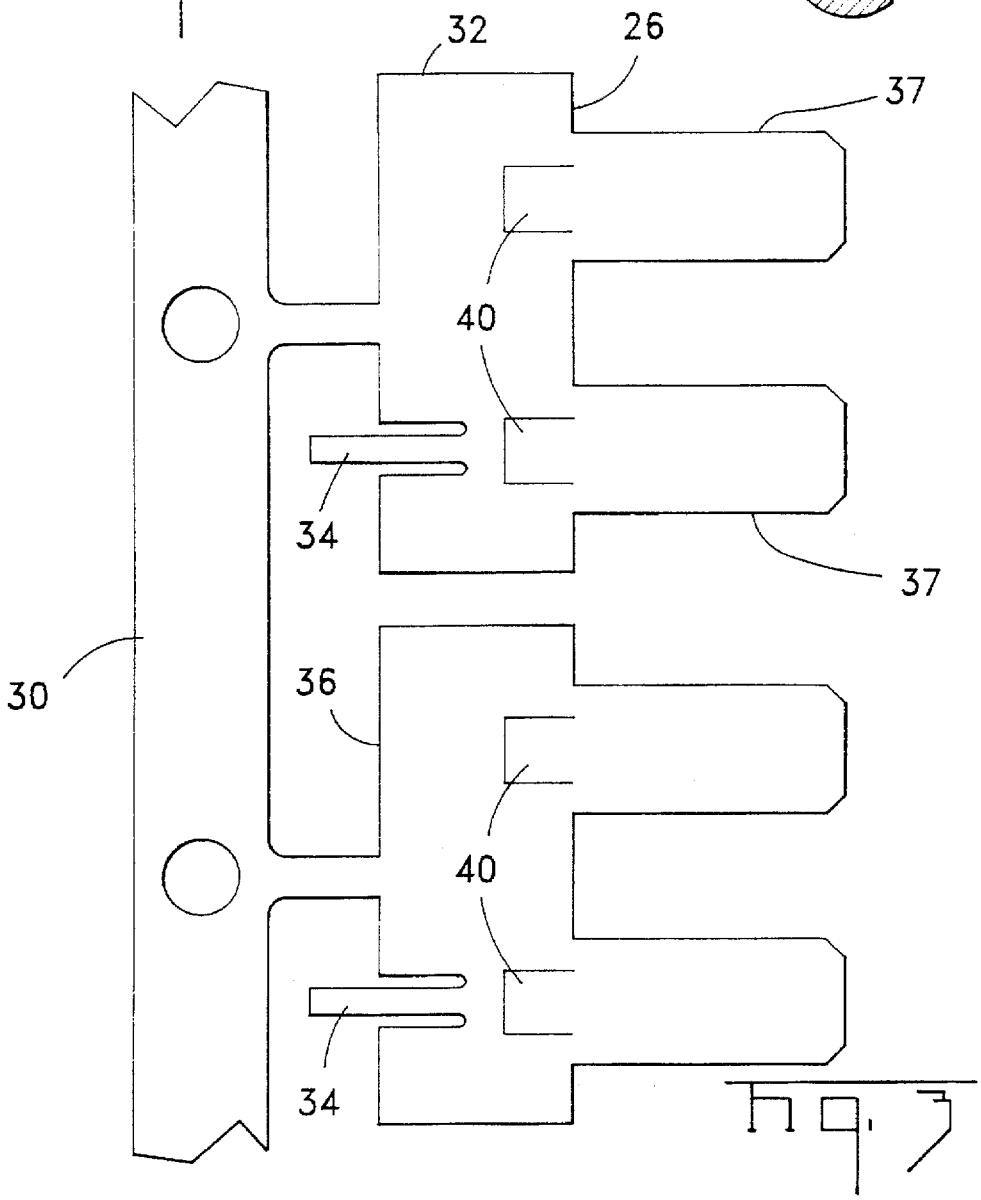
FIG. 3 is a plan view of a stamped, sheet metal, shell member, prior to forming, showing a plurality of the members connected to a removable carrier strip.
Figure 5:
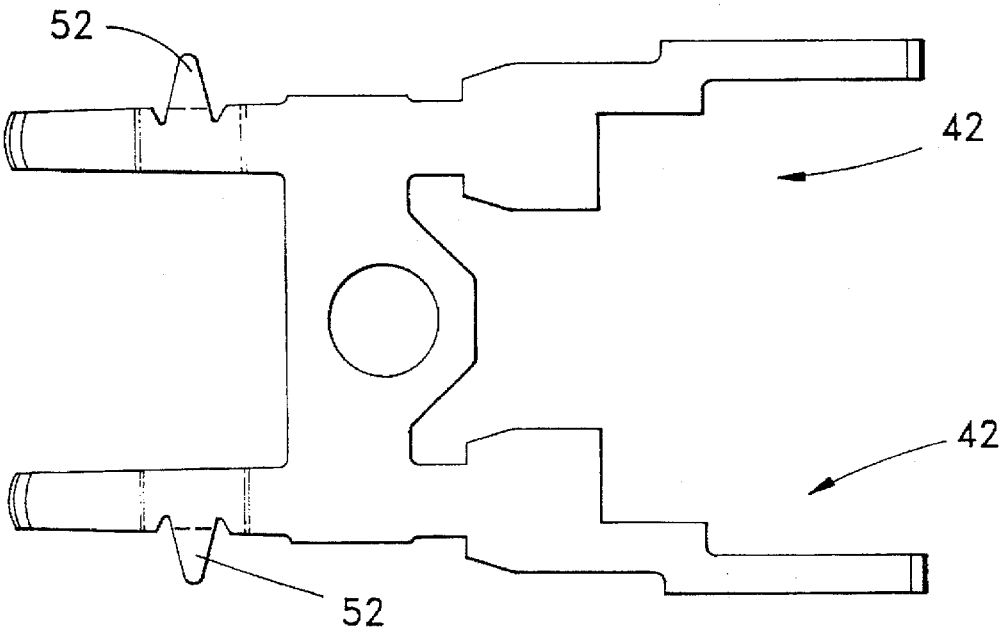
FIG. 5 is a plan view of a stamped sheet metal blank for a first switch contact incorporated into the switch connector of this invention.
Figure 6:
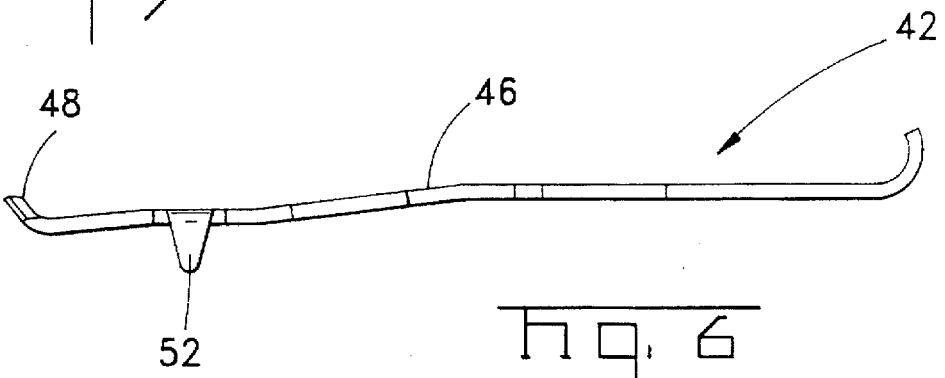
FIG. 6 is a side view of the first switch contact of FIG. 5, after preliminary forming.
Figure 7:
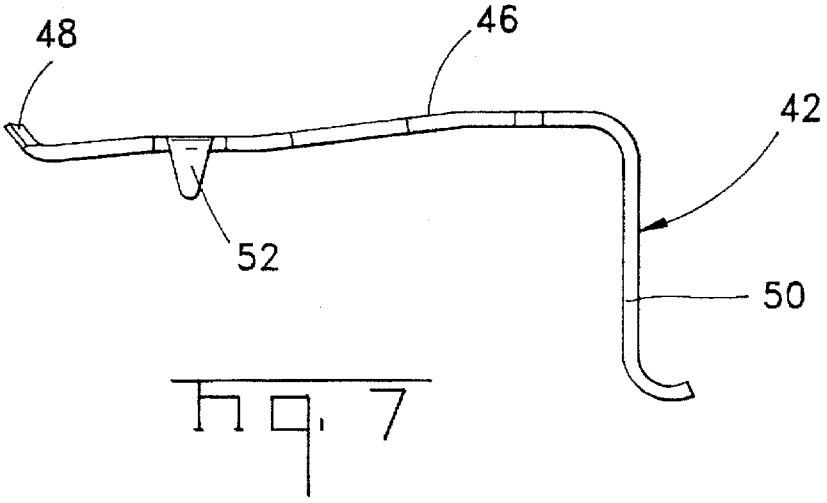
FIG. 7 is a side view similar to FIG. 6, but showing final forming thereof.
Figure 8:
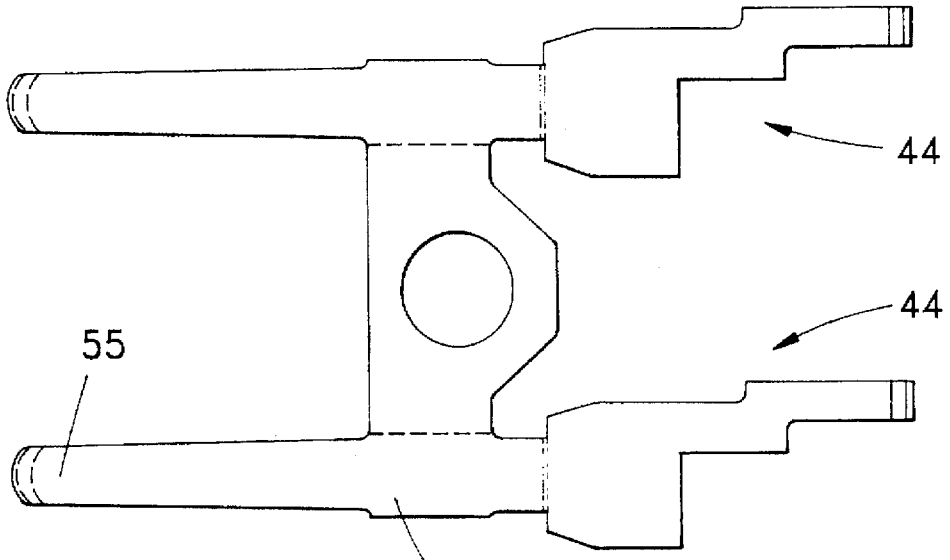
FIG. 8 is a plan view of a stamped sheet metal blank for a second switch contact incorporated into the switch connector of this invention, where such first and second switch contacts cooperate in a switching manner to be detailed hereinafter.
Figure 9:
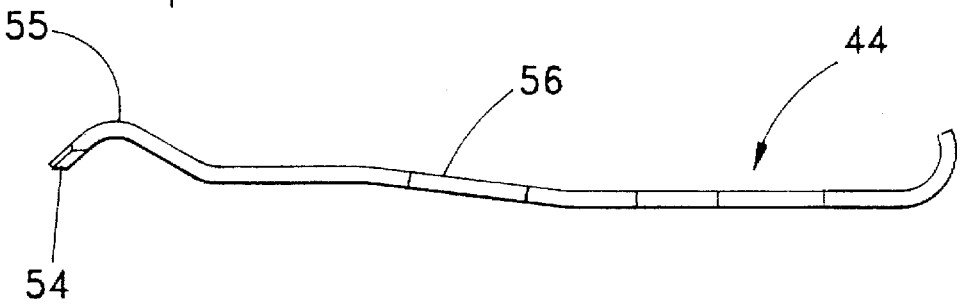
FIG. 9 is a side view of the second contact switch of FIG. 8, after preliminary forming.

Turning now to the details of the switch contact 12, the metal or conductive components thereof comprise a metallic shell 24, and first and second cantilevered, metal contacts, all of which are operatively mounted within the housing 14. FIGS. 3 and 4 illustrate, respectively, the stamped metal blank 26, and the formed shell 24. For ease of manufacturing and economics, the shell may be stamped from a continuous metal strip, such as phosphor bronze, where two such stamped shells are illustrated in FIG. 3 attached to a removable carrier strip 30. The shell is stamped to reveal a body portion 32, where an extension 34 has been provided along the edge 36. As will be seen in FIG. 4, this extension 34 is formed out of the plane of the shell where it ultimately will function as a solder tail for soldering to an appropriated trace or pad on the PCB. Another feature of the shell blank 26 is the provision of the two further extensions 37 from the body portion 32, where such extensions in the formed shell 24 are arcuate shaped to reveal an essentially cylindrical appearance. Finally, in order to fixedly secure the formed shell within the dielectric housing 14, provision is made for a pair of lances 40 to be struck from the body portion 32, preferably aligned with the extensions 37.

FIGS. 5 to 7 and 8 to 10 represent various views of the first and second contact arms 42,44, respectively, forming the switch contact 12, where such Figures illustrate stamped blanks, attached to a removable carrier strip, a preliminary formed contact, and a final formed contact. Considering the first contact arm 42 of FIG. 7, such contact arm includes an intermediate shank portion 46, an upwardly turned mating end 48, and a solder tail 50 formed generally at a 90 degree angle to said shank portion 46. Further, projecting normal to said shank portion is a contact extension 52, the function of which will be apparent in the description in the sequence of FIGS. 11 to 13.

Figure 10:
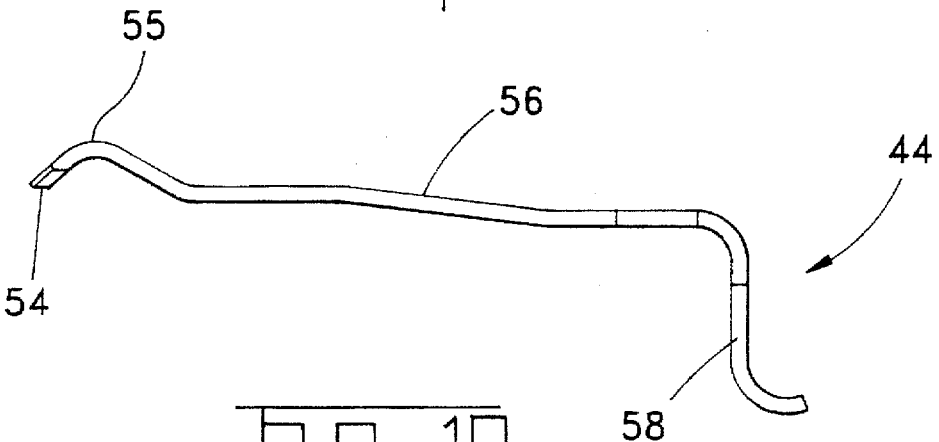
FIG. 10 is a side view similar to FIG. 9, but showing final forming thereof.

The second contact arm 44, illustrated in the fully formed position in FIG. 10, includes a mating end 54, where such end exhibits a reversely bent portion 55, an intermediate shank portion 56, and a formed solder tail 58, where such tail is generally formed at about a 90 degree angle to said shank portion 56.

Figure 11:
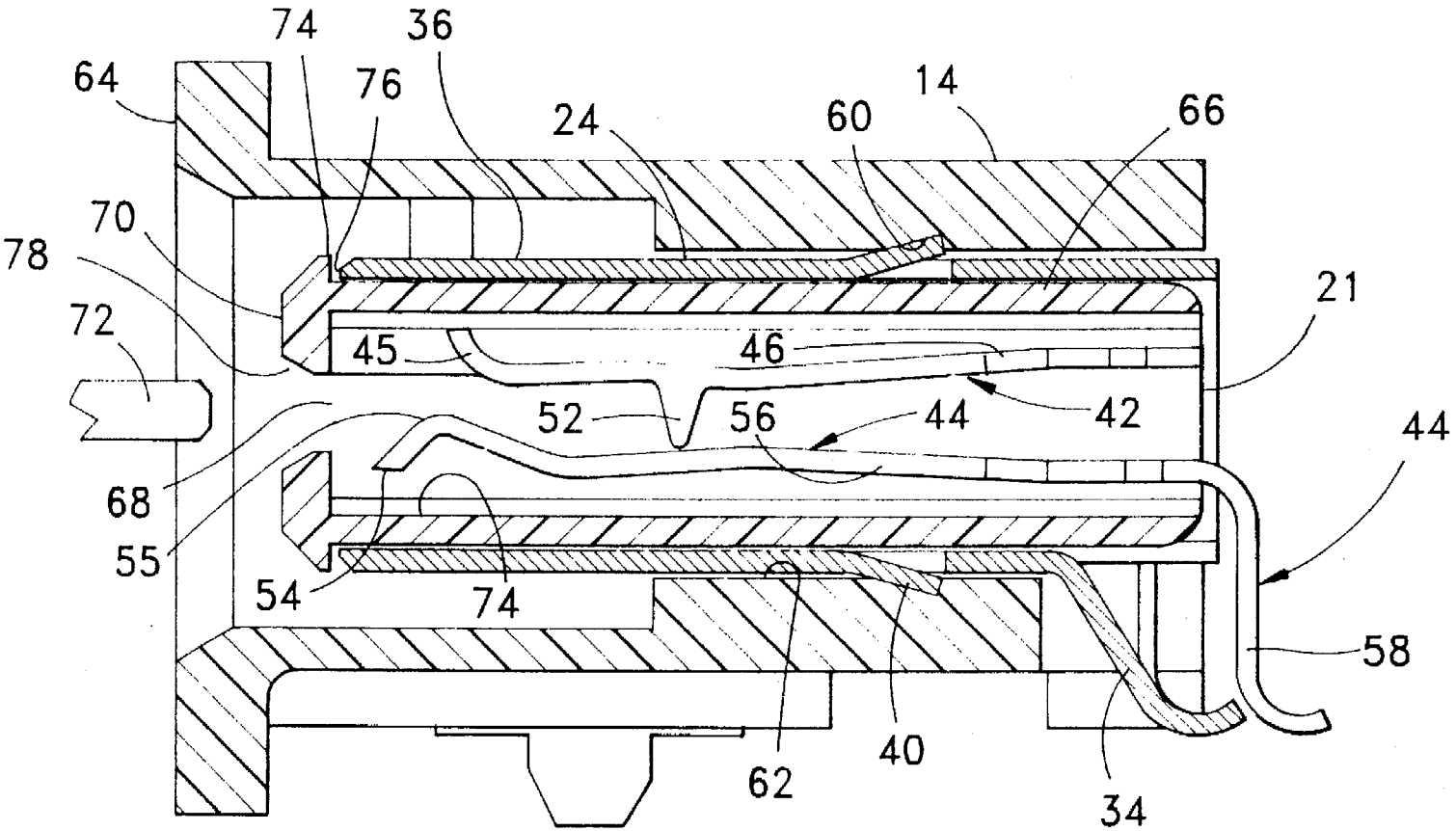
Figure 12:
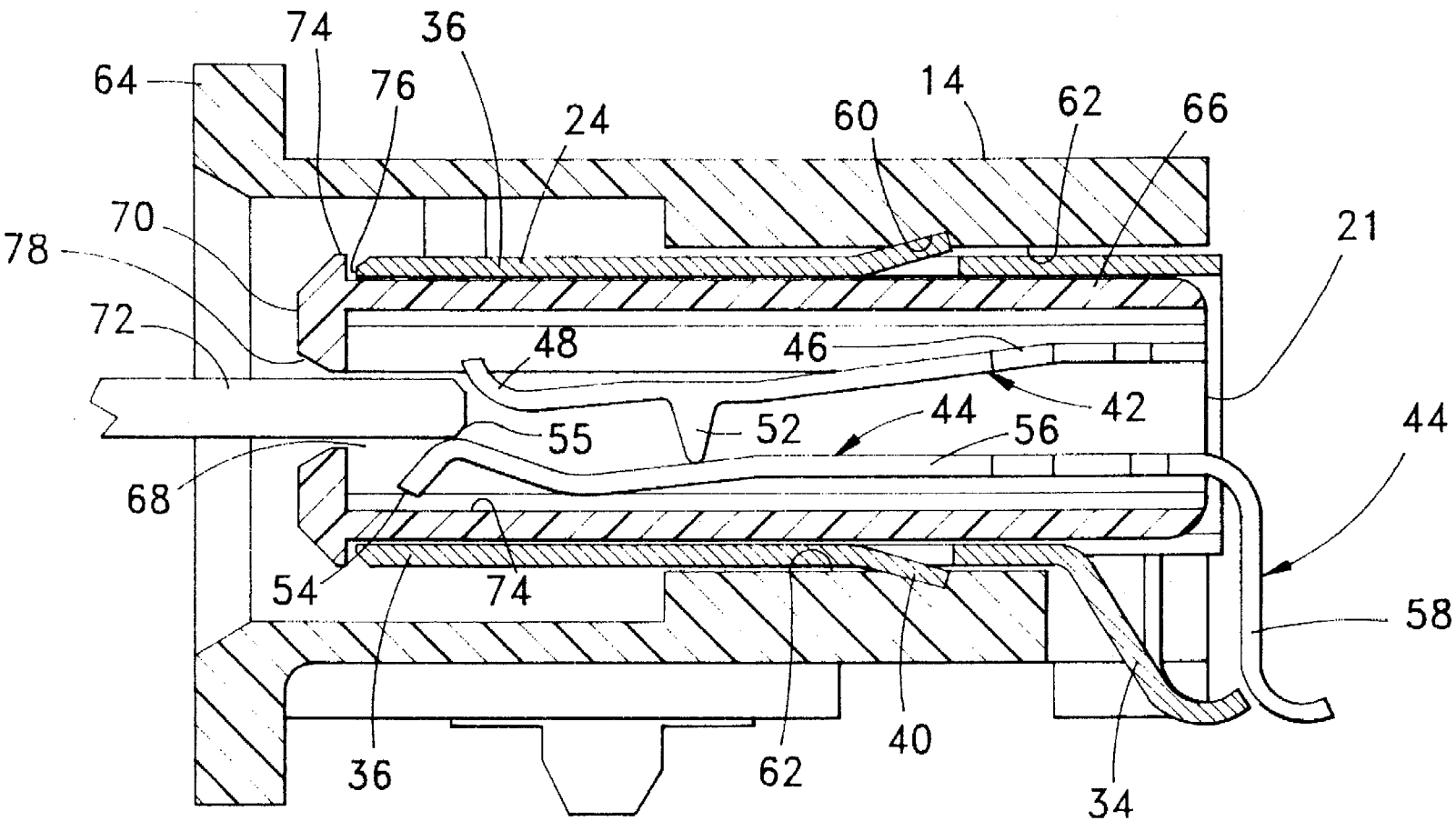
Figure 1:
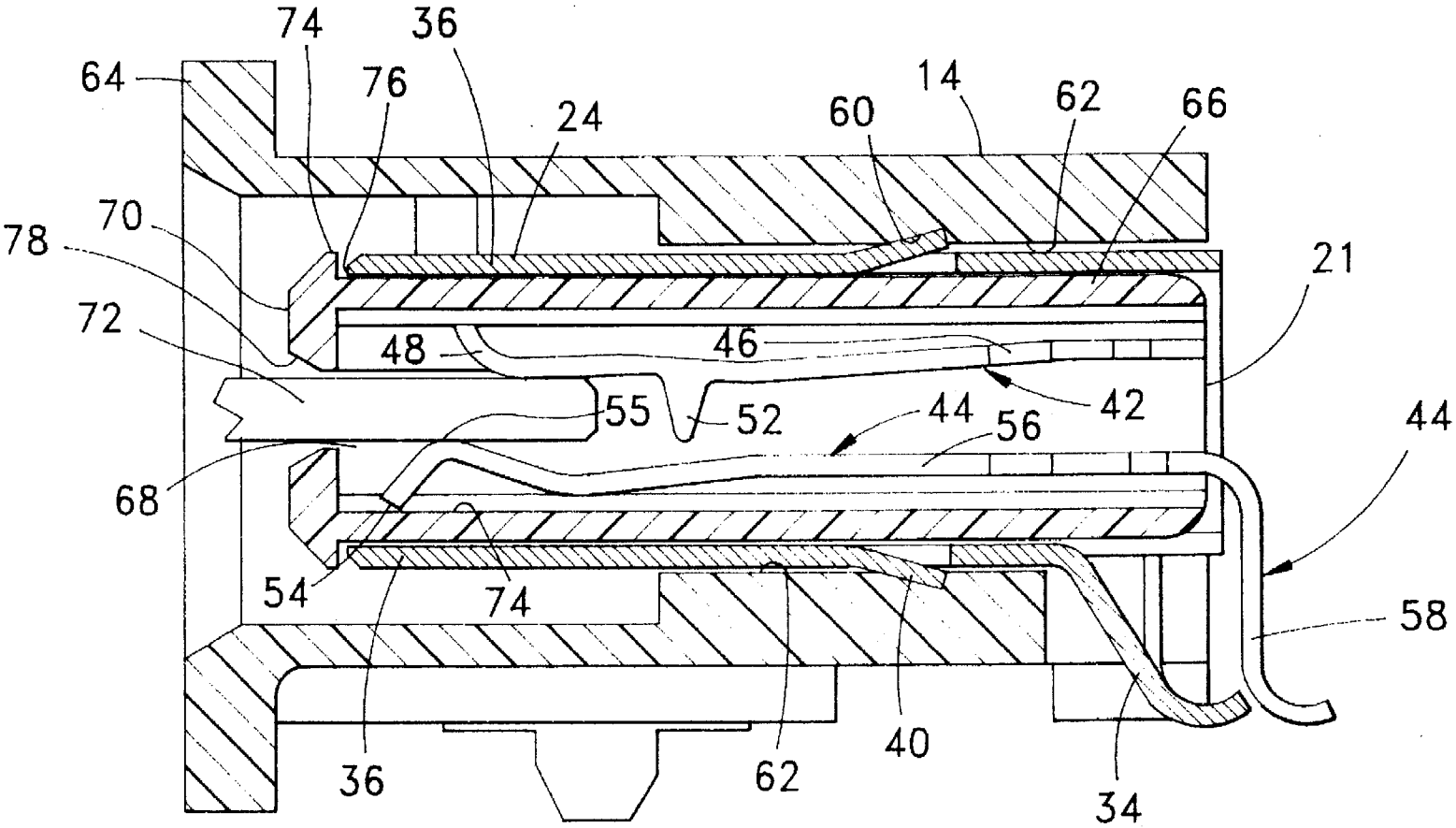

FIGS. 11 to 13 illustrate not only the assembled switch connector of this invention, but the mating sequence from an unmated state (FIG. 11), to a partially mated state (FIG. 12), and finally the fully mated state (FIG. 13).

In FIGS. 11–13 of the assembled connector, the formed shell 24 is shown mounted within the dielectric housing 14, and secured therein by the lances 40 seated in appropriate recesses 60 about inner wall 62 of the housing 14. The formed shell 24 is positioned with the extensions 36 directed forwardly toward the mating end 64, with the solder tail 34 extending rearwardly and downwardly for contact with the PCB upon which the connector housing 14 is mounted. Additionally, intermediate the formed shell 24 and the cantilevered contact arms 42,44 is a cylindrical dielectric insert 66 contiguous with the inner wall of the formed shell 24. The insert 66 includes a central cavity 68 with an open end 70 for receiving a contact 72 of a complementary connector, where only the contact 72 is illustrated in such Figures. The open end 70 features an annular shoulder 74 against which the end 76 of extensions 36 may abut. Additionally, the shoulder 74 may be provided with a tapered central opening 78 to facilitate entry of the complementary contact 72.

Within the central cavity 68, the respective contact arms 42,44, are mounted in cantilevered fashion at the rear 21 of the housing 14 at the shank portions 46, 56 just above the formed solder tails. By virtue of the spring properties of the formed metal contact arms 42,44, such arms are preset to be in intimate contact, namely contact extension 52 against shank portion 56, during a state of nonengagement with the complementary contact 72. A particularly important feature of this invention is the fact that the respective mating ends 48,54 of the contact arms 42,44 are axially offset from one another. That is, the mating end 54 of contact arm 44 is forward of the complementary contact arm 42, and represents the one to be initially contacted by the mating contact 72, see FIG. 12. As the mating contact 72 enters the cavity 68, the mating end 54 is pushed downwardly toward the inner wall 74 of the dielectric insert 66. Continued movement of the mating contact 72 results in wiping of the surface of the reversely bent portion 55. Concurrently with the downward movement of the contact arm 44, the companion contact arm 42, through the contact extension 52, continues to ride against the shank portion 56. However, since such contact arms 42,44 are cantilevered or pivoted from spaced-apart locations, while such contact (contact extension 52 against shank portion 56) remains, there is lateral movement therebetween resulting in a wiping action at the contact location.

As the mating action of complementary contact 72 continues, contact is made with the axially recessed contact arm 42 and contact is broken between the contact extension 52 and shank portion 56, note FIG. 13. Like its companion contact arm 44, contact arm 42 is moved upwardly toward the inner wall 74. With continued movement stopped, wiping of the mating end 48 is accomplished. By this mating and unmating action, wiping and backwiping is achieved at the critical contact locations, thereby minimizing the effects of oxides and contaminants that can alter the performance of this make-before-break switch connector.

Figure 14:
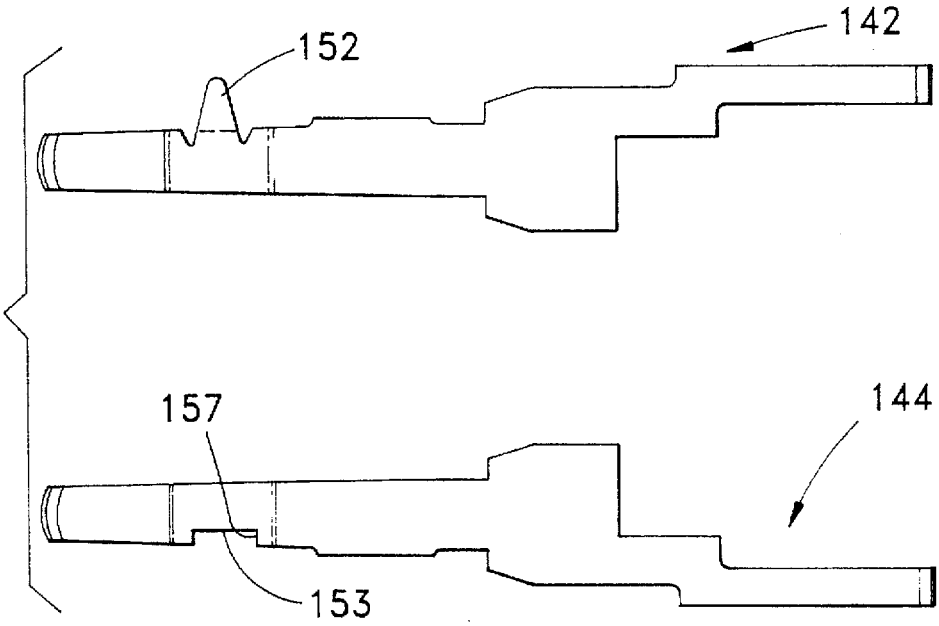
FIG. 14 is a plan view of stamped sheet metal blanks for a first and second switch contact of a second embodiment of this invention.
Figure 15:
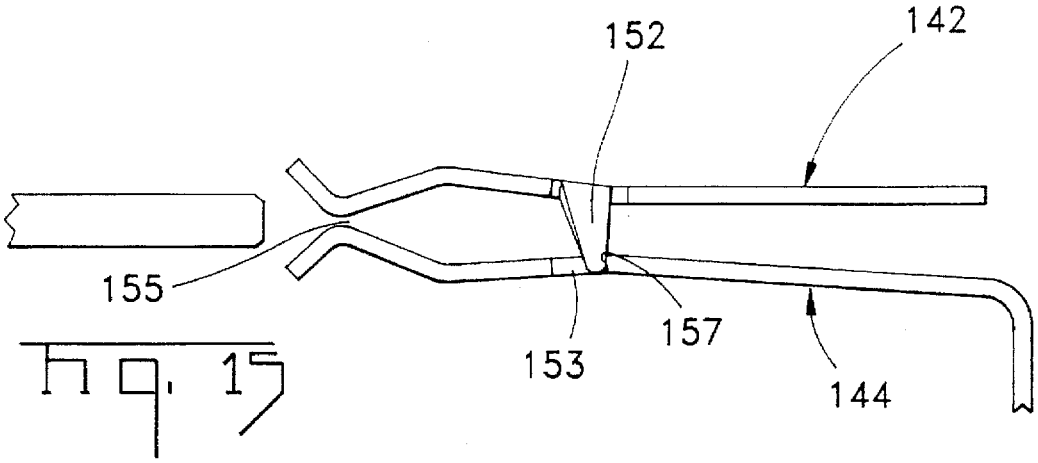
FIG. 15 is a side view of the first and second switch contacts of the second embodiment prior to mating with a complimentary connector.
Figure 16:
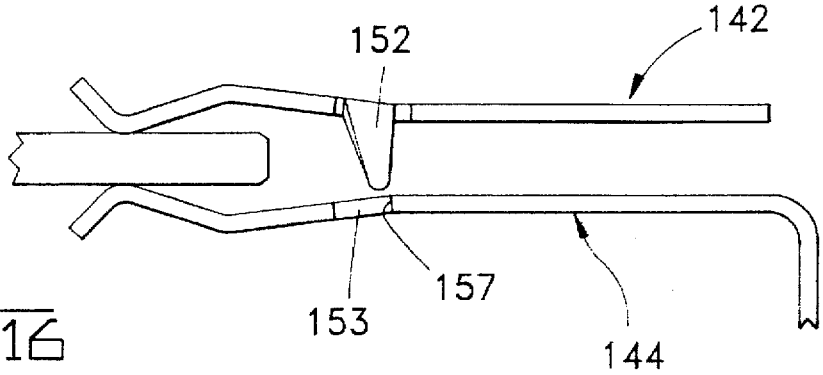
FIG. 16 is a side view of the first and second contacts of the switch connector after mating with the complimentary connector.

FIGS. 14–16 illustrate a second embodiment of the present invention. FIG. 14 shows blanks of alternate switch contact arms which may be used in the electrical switch connector 10 of FIGS. 1–13. The first contact arm 142 has a projection 152 similar to that of the first embodiment. The second contact arm 144 has a recess 153 to receive the projection 152 of the first contact.

FIG. 15 shows a side view of the alternate switch contact arms 142, 144 which may be used in the housing 14 of the first embodiment. The contact arms 142, 144 are shown here in the unmated position and the switch is closed because of engagement of the projection 152 with the new surface 157 of the recess 153.

FIGS. 15 and 16 show the cooperation of the projection 152 with the recess 153 of the second switch contact arm 144 during mating and unmating with a complementary connector. Prior to mating, the projection 152 is in contact with the rear surface 157 of the recess 153. As a mating connector is urged into the pin receiving area 155, the switch is opened by virtue of the fact that the projection 152 is released from the recess 153. As a result of this switching action caused by mating and unmating, wiping occurs between the rear surface of the projection 152 and the rear surface 157 of the recess 153 thus breaking down any oxide that may form on the switch contacts. This design offers similar wiping action as the first embodiment without the requirement of sequential mating to each of the switching contact arms 142, 144.

We claim:

1. An electrical switch connector adapted to be mated with a complementary coaxial cable connector, comprising:

(a) a first dielectric housing having a mating end and a termination end, (b) a second dielectric housing mounted within said first dielectric housing;

(c) a metallic shell disposed between said dielectric housings, and (d) a contact device within said second dielectric housing and comprising first and second aligned, spaced-apart switch contacts, said first switch contact having a fixed end, a shank portion and a mating end, where the mating end includes a reverse bent portion, and the second switch contact having a fixed end, a shank portion and a mating end, where the mating end includes a reverse bent portion, the improvement comprising in combination therewith the provision of said shank portion of said second switch contact having a contact arm extending toward and in contact with the shank portion of said first switch contact in an unmated condition, and said respective mating ends being axially offset from one another, whereby upon mating by said complementary connector contact is made sequentially with said mating ends and said contact arm is caused to wipe along the shank portion of said first switch contact to counter the effects of contaminants.

2. The electrical switch connector according to claim 1, wherein said respective switch contacts are preloaded to remain in electrical contact until contact is made with each switch contact by said complementary connector contact.

3. The electrical switch connector according to claim 1, wherein said metallic shell includes at least a pair of outwardly directed lances struck from the body thereof to engage complementary slots on said first dielectric housing, whereby to fixedly secure said shell to said first dielectric housing.

4. The electrical switch connector according to claim 1, wherein said metallic shell includes a pair of axially oriented arcuate extensions contiguous with said second dielectric housing, and said second dielectric housing includes an annular flange at one end thereof to fix the relative position of said metallic shell to said second dielectric housing.

5. The electrical switch connector according to claim 1, wherein said metallic shell includes a solder tail at said termination end to effect electrical contact with a planar electronic device.

6. The electrical switch connector according to claim 5, wherein each said switch contacts include a solder tail extending from said fixed ends to effect electrical contact with said planar electronic device.

7. The electrical switch connector according to claim 6, wherein said solder tails are surface mounted on said planar electronic device.

8. A switching arrangement for an electrical connector adapted to be mated with a complementary connector wherein said switching arrangement has dual contact locations that offer wipe and back wipe to said locations, said switching arrangement including a pair of cantilevered spaced-apart metal contact arms having free end portions and being mounted from a common wall, a first of said arms extending a fixed distance away from said wall and including an intermediate projection directed toward and contacting said second arm to define one of said contact locations, and the second of said arms extending generally parallel to said first arm but beyond said fixed distance, where the free end portions of said arms are positioned to define another of said contact locations and sequentially contact the complementary connector inserted therebetween.

9. The switching arrangement according to claim 8, wherein said first and second contact arms are preloaded to remain in electrical contact at said first location until contact is made by said complementary connector with said first contact arm.

10. The switching arrangement according to claim 9, wherein said intermediate projection is caused to move along the surface of said second contact arm, to thereby cause a wiping action thereagainst, until contact is made by said complementary connector with said first contact arm.

11. A female switching contact adapted for use in an electrical connector having an insulative housing and being matable with a complementary connector comprising:

a first contact arm adapted to be secured to the housing at a rear end thereof and having a projection extending toward and biased toward a second contact arm, the second contact arm being adapted to be secured at the rear end of the housing and having a receiving area for receiving the projection of the first contact arm, whereby the projection of the first contact arm defines a switch point with the second arm at a location where the projection of the first contact arm engages the receiving area of the second contact arm and the projection wipes with the receiving area at the switch point upon mating and unmating with the complementary connector.

12. A female switching contact as recited in claim 11 wherein the first and second contact arms are arranged such that free ends of each arm are simultaneously contacted by a male contact of the complementary connector.

13. A female switching contact as recited in claim 11 or 12 wherein the receiving area of the second contact arm comprises a recess.

* * * * *